US009021662B1

(12) United States Patent
Jones

(10) Patent No.: US 9,021,662 B1
(45) Date of Patent: May 5, 2015

(54) PAINT CAN HANDLE

(71) Applicant: Michael A. Jones, Elgin, IL (US)

(72) Inventor: Michael A. Jones, Elgin, IL (US)

( * ) Notice: Subject to any disclaimer, the term of this patent is extended or adjusted under 35 U.S.C. 154(b) by 0 days.

(21) Appl. No.: 13/999,227

(22) Filed: Jan. 30, 2014

Related U.S. Application Data

(60) Provisional application No. 61/849,648, filed on Jan. 31, 2013.

(51) Int. Cl.

| | |
|---|---|
| ***B65D 25/28*** | (2006.01) |
| ***B25G 1/12*** | (2006.01) |
| ***B25G 1/10*** | (2006.01) |
| *A47G 23/02* | (2006.01) |

(52) U.S. Cl.
CPC ..... *B25G 1/102* (2013.01); *B65D 25/2805* (2013.01); *A47G 23/0266* (2013.01); *B65D 25/2817* (2013.01)

(58) Field of Classification Search
CPC ..... B65D 25/28; B65D 25/2802; B65D 25/2805; B65D 25/2817; B65D 25/282; B65D 25/2829; B65D 25/2832; A47G 23/0266; B25G 1/102
USPC ..... 16/430, 422, 425, DIG. 25, 444, 446; 294/31.2
See application file for complete search history.

(56) References Cited

U.S. PATENT DOCUMENTS

| | | | | |
|---|---|---|---|---|
| 2,914,785 | A * | 12/1959 | Ela | 16/430 |
| 4,560,193 | A * | 12/1985 | Beebe | 294/31.2 |
| 4,885,818 | A * | 12/1989 | Arterbury | 16/430 |
| 5,558,240 | A * | 9/1996 | Karp | 215/398 |
| 5,813,092 | A * | 9/1998 | Greenfield et al. | 16/425 |
| 6,241,415 | B1 * | 6/2001 | Stark | 403/17 |
| 6,640,369 | B1 * | 11/2003 | Malvasio | 7/105 |
| 6,991,829 | B2 * | 1/2006 | Bergman | 427/429 |
| 7,284,300 | B1 * | 10/2007 | Bruns | 16/430 |
| 7,480,964 | B2 * | 1/2009 | Vidal | 16/430 |
| 7,581,770 | B2 | 9/2009 | Jones | |
| 7,604,270 | B1 * | 10/2009 | McCarthy | 16/425 |

(Continued)

FOREIGN PATENT DOCUMENTS

CA 2600268 12/2008

OTHER PUBLICATIONS

Bercom, HANDy Paint Pail, "Painting is easy with the HANDy Paint Pail!" www.handypaintpail.com, 2012, 1 page, printed Dec. 6, 2012.

(Continued)

*Primary Examiner* — Jeffrey O Brien
(74) *Attorney, Agent, or Firm* — Christopher John Rudy

(57) ABSTRACT

Handle for an object includes a member for grasping with a hand. The member has a lower opening for passage or accommodation of fingers and a web or palm of the hand, and an upper opening for passage or accommodation of a thumb of the hand. A strap may be attached to the member for embracing and securing the object. The strap can include a band portion having a tension buffer segment, and a band lock. The handle can be found in combination with the object, for example, a metal paint can, say, a one-gallon metal paint can.

16 Claims, 9 Drawing Sheets

(56) References Cited

U.S. PATENT DOCUMENTS

| | | | | |
|---|---|---|---|---|
| D617,194 | S | 6/2010 | Jones | |
| D617,640 | S | 6/2010 | Jones | |
| D617,641 | S | 6/2010 | Jones | |
| D634,634 | S | 3/2011 | Jones | |
| 8,032,991 | B2 * | 10/2011 | Lawless | 16/430 |
| 8,505,788 | B2 * | 8/2013 | Thibault | 16/425 |
| 2007/0056144 | A1 * | 3/2007 | Vidal | 16/430 |
| 2007/0285824 | A1 * | 12/2007 | Cornelissen | 360/69 |
| 2014/0157521 | A1 * | 6/2014 | Tuohy et al. | 7/105 |

OTHER PUBLICATIONS

Bercom, HANDy Paint Pail, "Disposable HANDy Paint Pail Liners!" www.handypaintpail.com, 2012, 1 page, printed Dec. 6, 2012.

Bercom, HANDy Paint Pail, "Disposable HANDy Paint Pail Covers!" www.handypaintpail.com, 2012, 1 page, printed Dec. 6, 2012.

* cited by examiner

PAINT CAN HANDLE

This claims the benefits under 35 USC 119(e) of provisional No. US 61/849,648 filed on Jan. 31, 2013 A.D. The specification of that application is incorporated herein by reference in its entirety.

FIELD AND PURVIEW OF THE INVENTION

This concerns a handle for an object, especially a paint can, and the handle with such an object. The handle has lower and upper openings; it can be attached to a strap for securing the object. A one-gallon metal paint can be the object of special concern.

BACKGROUND TO THE INVENTION

Painting is a fairly demanding occupation with various difficulties or obstacles attendant to its doing. Among these, particularly, for example, with respect to painting from paint cans, which would include the highly popular one-gallon paint cans that when full may weigh approximately ten pounds, can be mentioned mess and portability. As to mess, oversupply of paint on a brush, wet brush stowage when not using the brush, and simple spilling of paint from the can are common factors in or causes of this. As to portability, although paint cans, to include those made with metal, are typically supplied with a handle or bail, say, of metal, wrestling with the can, especially when a significant amount of paint remains in it, can be tiresome and problematic, for example, leading to early fatigue and less painting efficiency, and even back to the difficulty or obstacle of dealing with mess engendered through spilling. And openers may be lost or hard to use.

The HANDy Paint Pail is a known device meant to ease painting. It is a specially molded plastic container generally in a form of a cup on which an adjustable plastic strap having an annular mount is mounted over the rim of the cup, with the strap portion dropping down to be connected with several studs on the bottom of the cup so as to form a side handle. A magnet on the inside of the rim mount holds a paint brush in a supply of paint in the cup. For painting, paint is poured into the cup bearing the handle. A disposable liner may be placed in the cup before filling. A disposable cover may be employed to keep paint from drying out during periods of inactivity. To clean up after painting, leftover paint is poured back into the paint can and covered there; then the HANDy Paint Pail device is put away. However, drawbacks remain. Among these may be mentioned that the device can engender the purchase and use of extra components such as disposable liners and covers; it is bulky in storage, with its cup and handle; it is cleaned for reuse; paint is transferred in and out of the device; hand fatigue still can be appreciable; and the brush stowed in the paint can engender mess through oversupply.

Henry James Jones has provided a can handle, which includes a member for grasping with the hand, and a strap attachable to the member for embracing and securing the object. The strap includes a band portion having a tension buffer segment and a band lock. The handle can be found in combination with the object, which, for example, may be a large metal coffee can. See, U.S. Pat. No. 7,581,770 B2 and CA 2,600,268. See also, U.S. Pat. No. D617,194 S; U.S. Pat. No. D617,640 S; U.S. Pat. No. D617,641 S; and U.S. Pat. No. D634,634 S. As good as those configurations or designs are, especially with respect to handling a three-pound can of coffee, they are not without their drawbacks, notably with respect to painting, and many of the difficulties or obstacles attendant to painting are not adequately addressed, if addressed at all, especially with respect to painting from a metal paint can.

It would be desirable to ameliorate if not solve one or more of the difficulties or obstacles attendant to painting, especially with respect to painting from a metal paint can. It would be desirable to provide the art with an alternative.

A DISCLOSURE OF THE INVENTION

Provided is a handle for an object, which comprises a member for grasping with a hand, wherein the member has a lower opening for passage or accommodation of fingers and a web or palm of the hand, and an upper opening for passage or accommodation of a thumb of the hand. A strap may be attached to the member for embracing and securing the object. The strap can include a band portion having a tension buffer segment, and a band lock. The handle can be found in combination with the object, for example, a metal paint can, say, a one-gallon metal paint can. It may have further versatility.

The invention is useful in handling objects and so forth, especially in painting.

Significantly, by the invention, the art is advanced in kind. Notably, for example, one or more of the difficulties or obstacles attendant to painting, especially with respect to painting from a metal paint can, is or are ameliorated if not solved. The art is provided with an alternative. With the handle, painting directly from the paint can be done simply and with high efficiency. No pouring out or pouring back in of paint from or into the can is required. Thus, too, cleanup is made significantly easier. Special additional containers, and special liners and covers for such containers, as well as storage of cumbersome parts, can be avoided. The handle member is ergonomically configured so as to ameliorate stress on and fatigue of the hand and its digits when manipulating an object to which it is attached such as a paint can, and provide for various secure gripping positions, yet being such that the object can be controlled readily and surely—and these things even with a full, ten-pound, one-gallon, metal paint can as the object. The handle can be very comfortable in use. It can be embodied with additional features to increase its efficiency and versatility. For instance, brush stowage on the handle member can be made more efficient, with oversaturation with paint of a brush stowed on the handle able to be avoided, and one or multiple add-on location(s) for stowing brushes or other painting implements or tools, or a messy paint can lid, can be provided for hands-free holding and handling of such items, for example, with magnets on various locations of the handle, which can help control dropping of the items, dripping and spillage of paint, and mess in general. An add-on paint can opener can be provided with the handle member, which can be convenient and efficient. A built-in hammer heel, say, for tamping shut paint can lids, can be provided. It can be embodied so as to form a flat configuration with respect to the strap for ease of storage when not in use. The handle can be aesthetically pleasing. It can be efficient to manufacture. The handle member may be provided in a mirror-image configuration for convenient use with either the left or right hand. The handle member may be made in a split form configuration, which can enhance its manufacturing ease, decrease amounts of materials needed to make it, lessen its cost, reduce its weight, and so on. Numerous further advantages attend the invention.

The drawings form part of the specification hereof. With respect to the drawings, which are not necessarily drawn to scale, the following is briefly noted:

Figure 5:
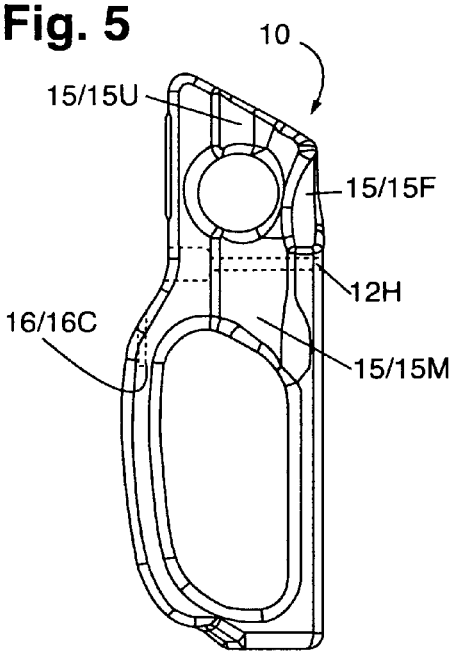
Figure 6:
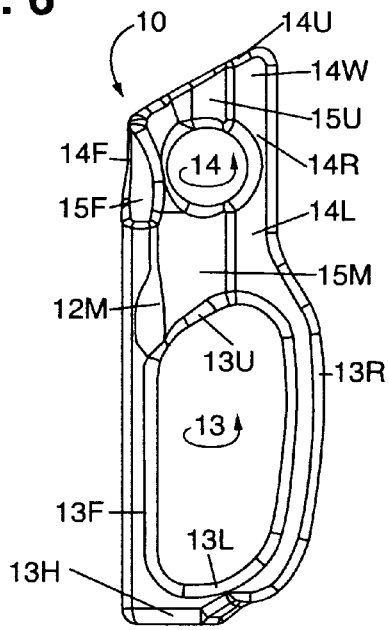
Figure 7:
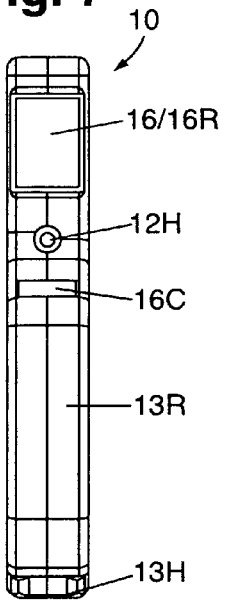
Figure 8:
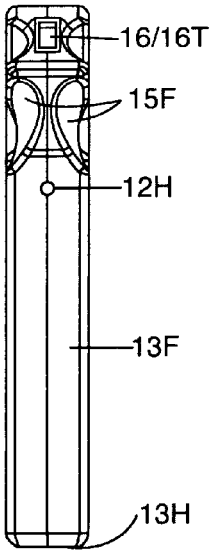
Figure 9:
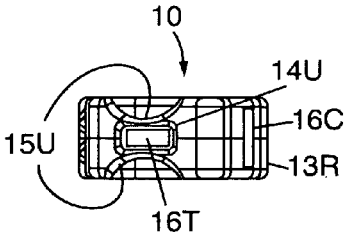
Figure 10:
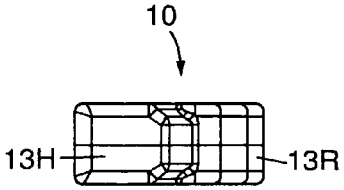
Figure 11:
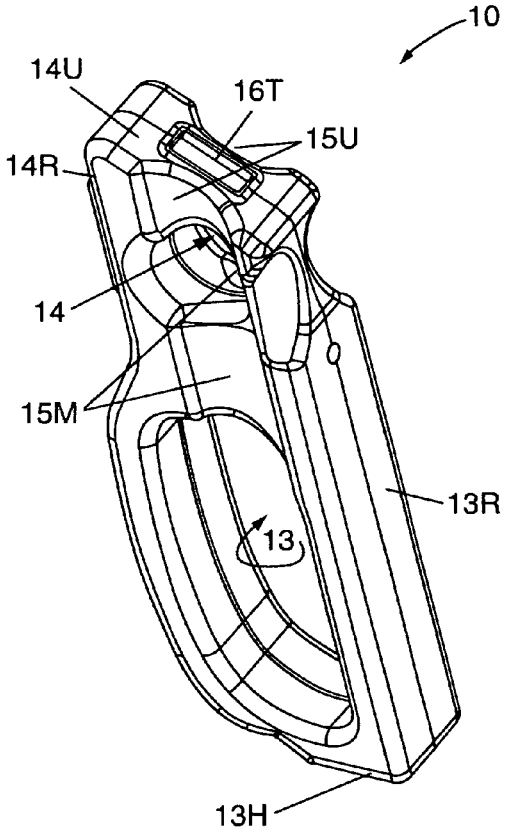
Figure 12:
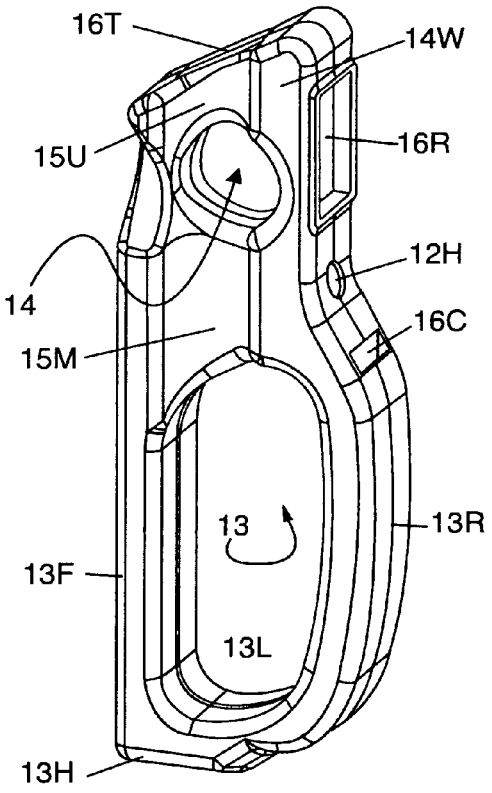
Figure 13:
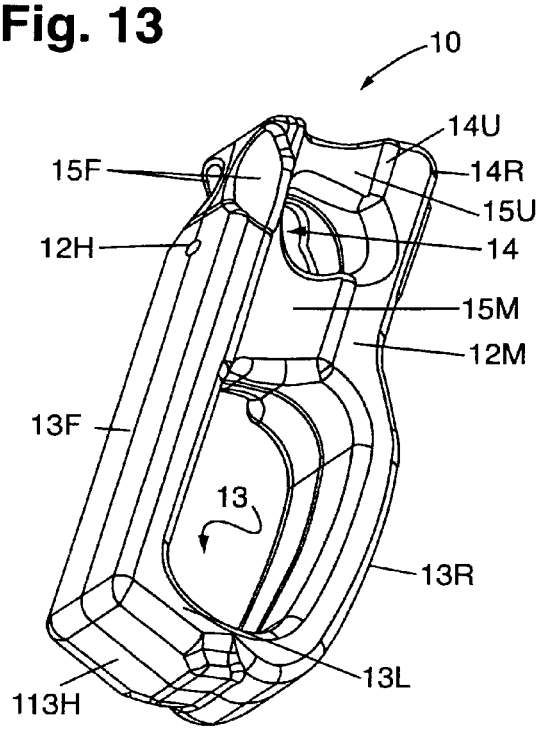

FIGS. 5-13 are wire frame views of a handle member as found within FIGS. 1-4 without but capable of receiving add-on features, and nut, bolt and strap—with FIG. 5 a left side view (taken in a direction from the intended attached object and away) in elevation; FIG. 6 a right side view in elevation; FIG. 7 a rear view in elevation; FIG. 8 a front view in elevation; FIG. 9 a top view; FIG. 10 a bottom view; FIG. 11 a perspective view from the left, front and top; FIG. 12 a perspective view from the right, rear and top; and FIG. 13 a perspective view from the right, front and bottom.

Figure 14:
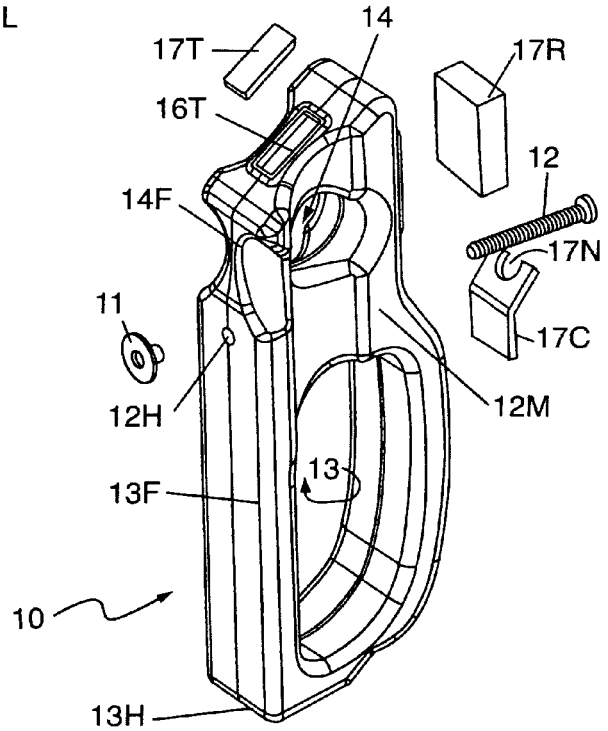
Figure 15:
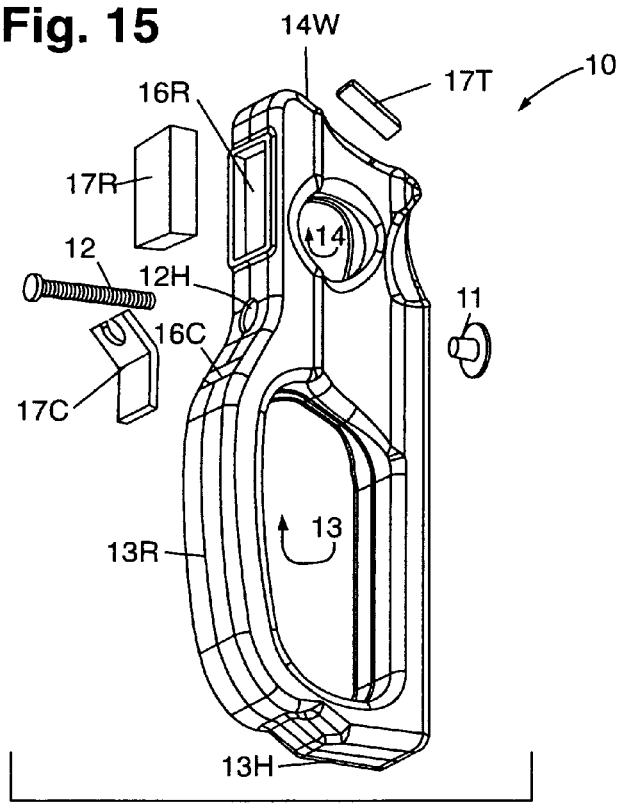
Figure 16:
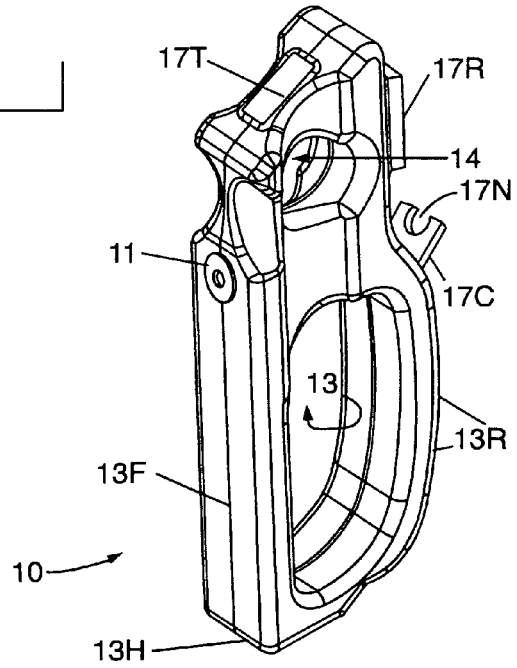

FIGS. 14-16 are wire frame views of a handle member as found within FIGS. 1-4 having add-on features including a nut and bolt, but excluding the strap—with FIG. 14 an exploded perspective view from the right, front (again taken in a direction from the intended attached object and away) and top; FIG. 15 an exploded perspective view from the left, rear and bottom; and FIG. 16 a perspective view from the right, front and top.

Figure 17:
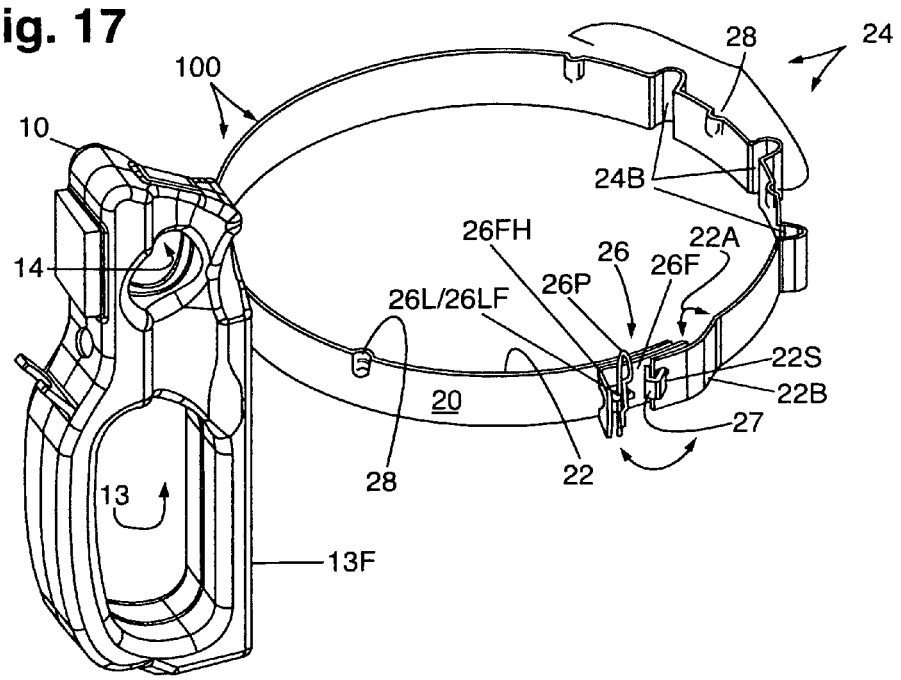

FIG. 17 is a perspective view from the right, front (again taken in a direction from the intended attached object and away) and top of the handle member and strap assembly as found within FIGS. 1-4, without the paint can attached thereto.

Figure 18:
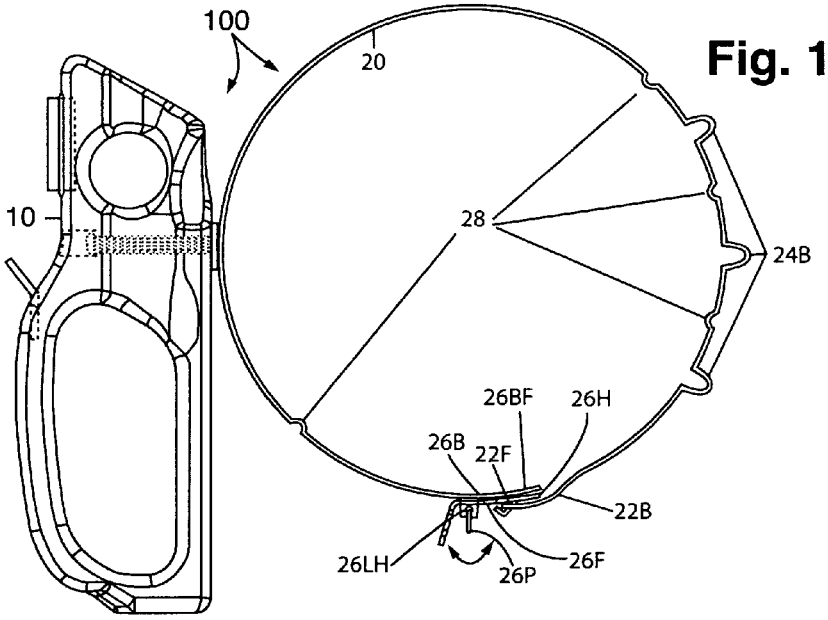

FIG. 18 is a side view in elevation of the handle member and strap assembly of FIG. 17, with its inner nut and bolt loosened, and the strap rotated to substantially lie in the same general plane as that in which the bulk of the handle member itself lies. This is a configuration advantageous for point of sale purposes as well as storage when not used.

Figure 19:
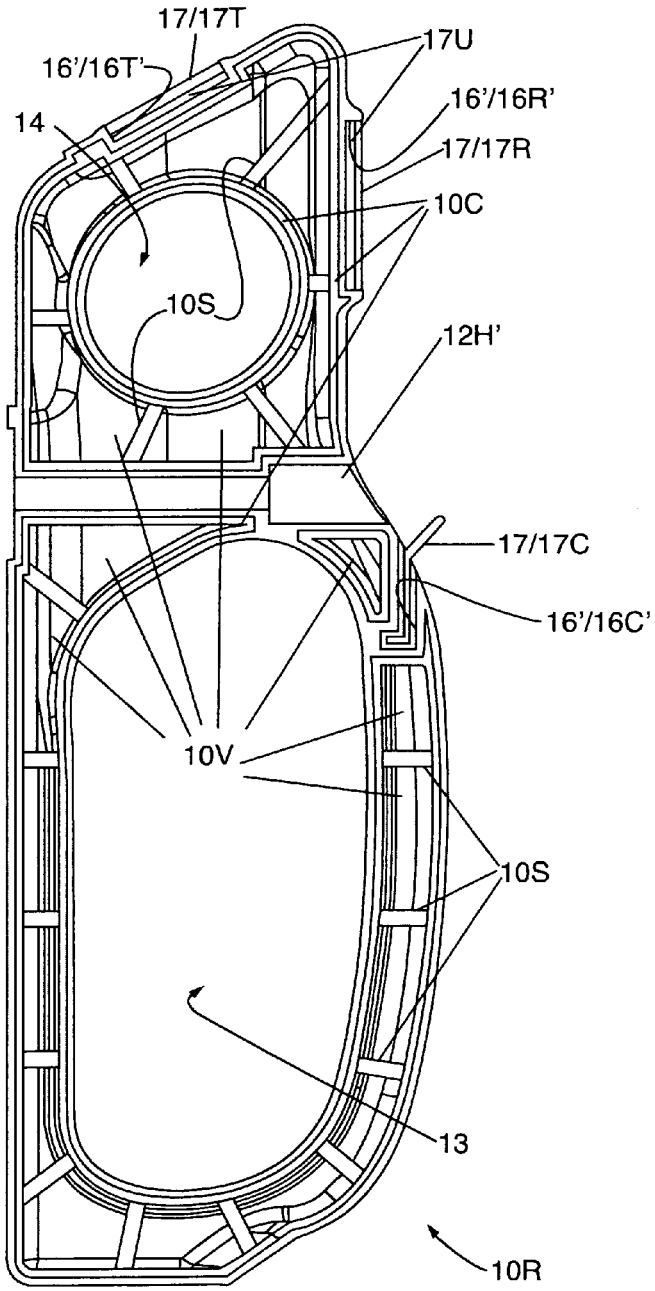

FIG. 19 is a side view of a right half interior of a split handle member, which can be assembled with its complimentary left half to form a complete, assembled split handle member. As with the handle members found in FIGS. 1-18, the complete assembled split handle member can be employed with a strap assembly as in FIGS. 1-4, 17 and 18.

The invention can be further understood by the detail set forth below, which may be read in view of the drawings. The same, as with the foregoing, is to be taken in an illustrative and not necessarily limiting sense.

Any suitable material(s) can be employed to make the present handle. For instance, the member for grasping with the hand can be made of a solid generally inert material such as metal, wood or a suitable plastic, for example, polypropylene. A rubber coating may be applied for better gripping capability and comfort. The band member of the strap can be made of any suitable strong material having some spring-like qualities such as a relatively inert metal, to include steel and so forth, for example, stainless steel. Thus, any tension buffer segment can effectively operate, and a lock snap segment if provided of one piece with the remaining part of the band can efficiently operate as well, with other feature(s) of the band such as the inside protuberances can be provided in the band to position the strap vertically can be provided, all while the band securely embraces the object and the strap and handle permit its easy manipulation.

Any suitable method(s) can be employed to make the handle. For instance, the handle member may be molded and/or machined, and the strap may be cut and stamped.

With reference to the drawings, handle 100—which advantageously is for use by hand 7 typically having digits 7D and thumb 7T, which, it or its mate, in the course of the work may manipulate tools 8, for example, painting tools such as paint brush 8B, spackling compound knife 8K, scraper (not illustrated) or paint can lid (not illustrated) and so forth, and for embracing and securing object 9, for example, a can, say, as a metal paint can, which may be a one-gallon metal paint can—includes member 10 for grasping with the hand 7. A strap 20 is typically attached to the member 10 for reversible attachment and detachment from the object 9. The strap 20 can be attached to the member 10 by inner nut 11 and bolt 12 or other fastener such as screw(s), rivet(s), clip(s) and/or glue, and secure the object 9.

Figure 1:
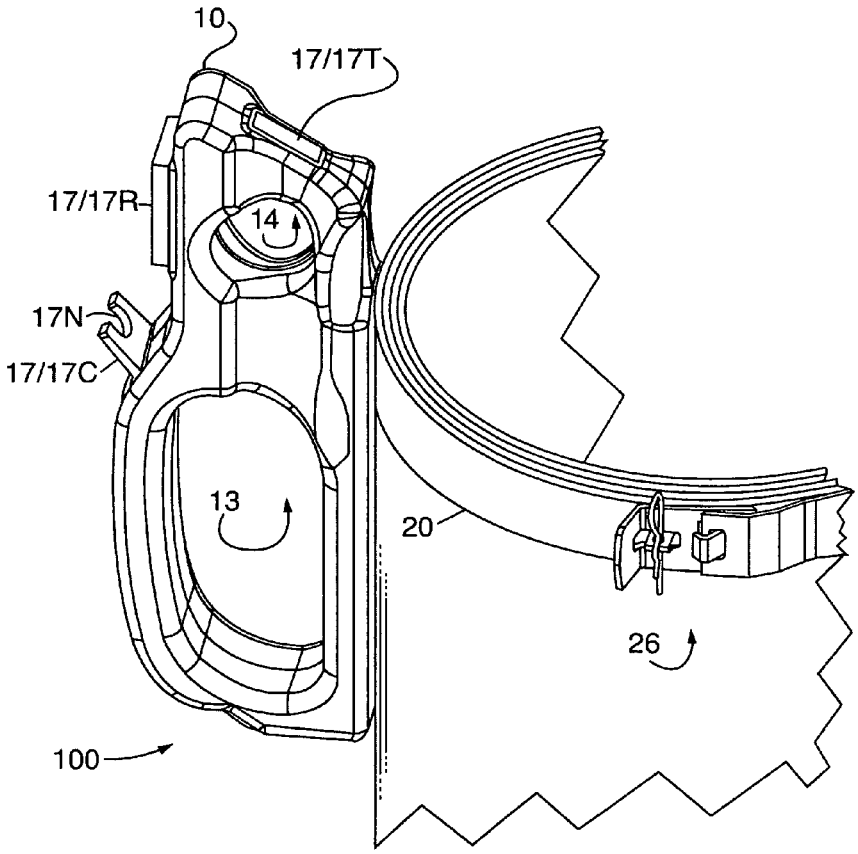
FIG. 1 is a perspective plan view of an instant handle member with strap, attached to an object, here, a one-gallon metal paint can.
Figure 2:
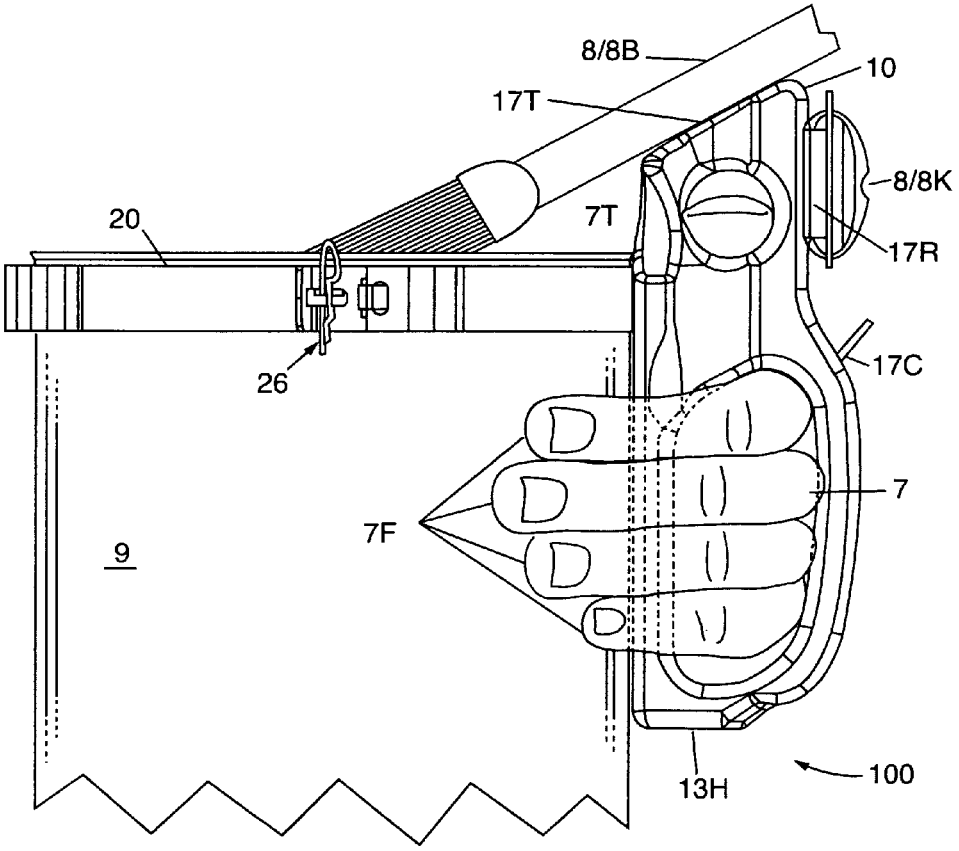
FIG. 2 is a side view of the handle member with strap and can of FIG. 1, held by a left hand, with a paint brush and a spackling knife reversibly stowed magnetically.
Figure 3:
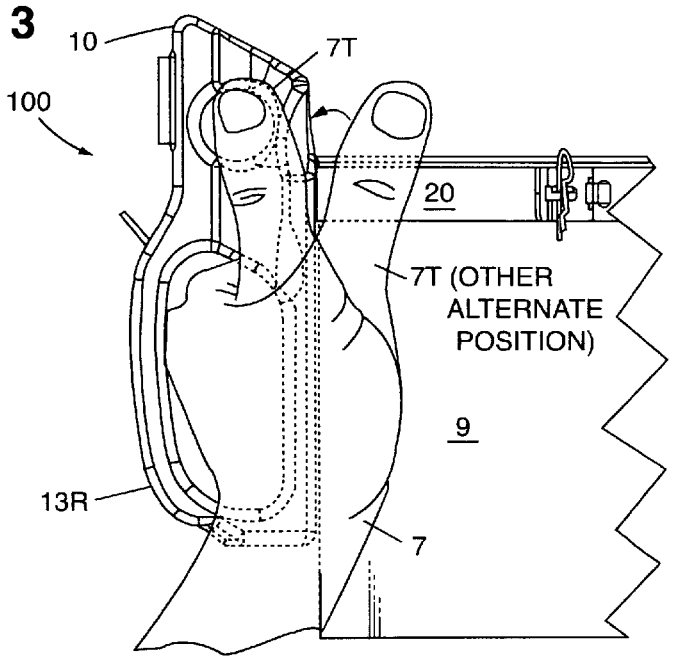
FIG. 3 is a view of the handle member with strap and can of FIG. 2, taken from the opposite side and still held by the left hand with the same general grip, but with the thumb resting in two alternate positions.
Figure 4:
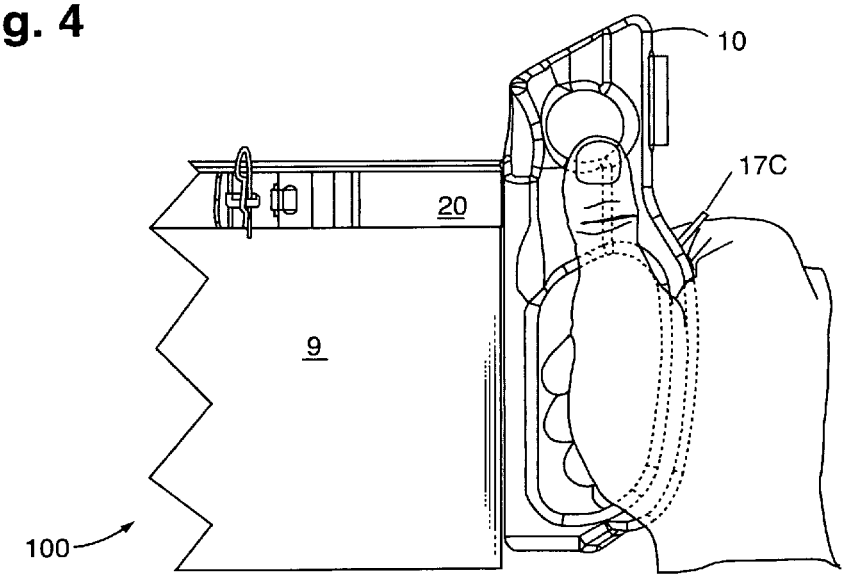
FIG. 4 is a side view of the handle member with strap and can of FIG. 1, being held by a right hand and in a different grip than that which is illustrated in FIGS. 2 and 3.

The member 10 can include, in addition to the inner nut 11 and bolt 12, bolt accommodating hole 12H passing through thick or stout mid-section 12M. Lower opening 13, say, for the hand 7, is provided, which may be bounded and be in a form of a closed loop, and which can include front portion 13F that may be placed into contact with the object 9 and be thinner nearer the bottom away from the object 9 so as to more closely accommodate a slightly upward, underhand grip for less stressful use; lower portion 13L, which may close the loop, and provide or blend into built-in hammer heel 13H for tapping shut a lid such as for a can of paint as the object 9; rear portion 13R, which may be thick and stout enough to be grasped if desired; and upper portion 13U, which blends into the handle member mid-section 12M. Upper opening 14, say, for the thumb 7T, is provided, which also may be bounded and be in a form of a closed loop, and which can include front portion 14F; lower portion 14L, which also blends into the handle member mid-section 12M; rear portion 14R; and upper portion 14U, which may be extended, say, more upwardly about the rear to provide a wedge 14W sloping down from the rear portion 14R to the front portion 14F. Among its ergonomic features, which can enhance holding and stability, may be found digit-placement impressions 15 such as front impression 15F, say, for the thumb 7T when the hand 7 is in a first grasping position (FIGS. 2 and 3); middle impression 15M, say, for the thumb 7T, particularly when the hand 7 is found to grasp from a different position with respect to the member 10 (FIG. 4); and upper impression 15U, say, for the thumb 7T also when the hand 7 is in the first grasping position (FIGS. 2 and 3). Also provided may be add-on component receiving openings 16, which may be provided in blind form, such as paint can remover receiving opening 16C; rear magnet receiving opening 16R; and upper magnet receiving opening 16T—into which correspondingly may be provided add-on component 17 such as paint can remover 17C, say, of a metal such as steel, which may have notch 17N to ease insertion, tightening and loosening of the bolt 12; rear magnet 17R, say, a ceramic magnet for holding a tool 8, for example, an unused paint brush 8B, the spackling knife 8F, a paint scraper, or the like; and top magnet 17T, say, a rare-earth magnet such as for holding a wet paint brush 8B in a position over an open paint can as the object 9 but without its bristles being immersed in the paint (FIG. 2) or for holding a paint can lid, which may have wet paint adhering to it and be positioned so that that paint faces up. The member 10 can be gently curved and rounded, especially in those portions expected to be in contact with the hand 7 or its fingers 7F or thumb 7T, so as to provide more comfort and less stress in use.

The member 10 may be provided from a split form configuration, say, with right half 10R (FIG. 19) and a corresponding left half, which are assembled, say, by press fitting, gluing and so forth, so as to form a complete, assembled split member. In general, the features of the complete, assembled split member correspond to those of the member 10 that is not split as noted above, and, as with the non-split member 10, a rubber or rubber like coating for comfort and/or enhanced gripping capability may be applied. However, one side may have interiorly channel 10C, say, in the right half 10R, into which, as a female receptacle, a corresponding protrusion, say, in the left half, as a male member, is inserted for more secure assembly. One or both of the right half 10R and corresponding left half may include support columns 10S interspersed with hollow or void spaces 10V to save on materials, for example, when the member 10 is made with plastic, as well as time, for example, when injection molding is employed, noting that a split form configuration member half may be injection molded at a rate of about one per forty seconds whereas a one-piece member 10 may take about five minutes. Other features may be allotted between the right half 10R and the corresponding left half. For example, present in each member half may be bolt accommodating hole half 12H' to provide for the bolt accommodating hole 12H upon assembly; and add-on component receiving opening halves 16', which may be provided in blind form, such as paint can remover receiving opening half 16C', rear magnet receiving opening half 16R', and upper magnet receiving opening half 16T'. In the case of the add-on receiving opening halves 16', 16C', 16R', 16T', the split form configuration can enhance ease of assembly of add-on components 17 such as the paint can opener 17C, rear magnet 17R and top magnet 17T, and, in the case of the rear magnet 17R and top magnet 17T, enhance magnet securement with underlying metal magnet supports 17U on which the magnets 17R, 17T are mounted, say, with glue.

The strap 20, in general, can be one such as that disclosed in the aforementioned patents to Henry James Jones, say, U.S. Pat. No. 7,581,770 B2, and thus include band portion 22, for example, of about ¾-inch high approximately 20-gauge thick stainless steel, or suitably thicker, which may have first inner facing back fold 22F held with a spot weld, and vertically oriented slot 22S at a first end, and has tension buffer segment 24, made, for example, of bend(s) 24B in the band portion 22. More deeply bent or more numerous bends 24B can make for more flexibility in the strap 20. Over the center band lock 26 can include base 26B, which may be considered to be an extension of the band portion 22 or its second end, which may have second inner facing back fold 26BF held with a spot weld to be folded to wrap through slot 26S to attach fold segment 26F; hook 27 and flap-receiving hole 26FH in the fold segment 26F; hinge 26H; and latch 26L, which can be can be provided as an outwardly extending flap 26LF cut out and folded upward from the base 26B and having hole 26LH in it, with such a flap 26LF able to be inserted through the hole 26FH in the fold segment 26F for insertion of the latch 26L, with securing of the lock 26 accomplished by insertion of pin 26P. The band portion 22 can have predetermined angle 22A, for example, 45-50 degrees, in bend 22B. Folding the band lock 26 into a position, where it can be secured with the latch 26L and pin 26P, tightens the band portion 22 of the strap 20 about the object 9, with appropriate "give" provided by the tension buffer segment 24. Protuberance(s) 28 can be provided inside in the band portion 22 to position the strap 20 vertically in a groove of the object, if one may be found at a suitable location, say, higher up on a paint can, or otherwise to grip a smooth surface.

CONCLUSION TO THE INVENTION

The present invention is thus provided. Various feature(s), part(s), subcombination(s) and/or combination(s) can be employed with or without reference to other feature(s), part(s), subcombination(s) and/or combination(s) in the practice of the invention, and numerous adaptations and modifications can be effected within its spirit, the literal claim scope of which is particularly pointed out as follows:

What is claimed is:

1. A handle for an object, which comprises a member for grasping with a hand, wherein the member has a lower opening for passage or accommodation of fingers and a web or palm of the hand, and an upper opening for passage or accommodation of a thumb of the hand;

wherein the member comprises a thick middle section between the upper opening and the lower opening, a bolt accommodating hole extending through the middle section;

the member further comprises:

a first digit-placement impression comprising a front impression in a front location between the upper opening and a location closer to where the object would be located when attached to the handle, into which the thumb may be placed in a first grasping position of the thumb and a first grasping position of the hand when grasping the handle by the member;

a second digit-placement impression comprising a middle impression in a middle location on the middle section between the lower opening and the upper opening, into which the thumb may be placed in a second grasping position of the thumb and a second grasping position of the hand when grasping the handle by the member; and a third digit-placement impression comprising an upper impression in an upper location above the upper opening but further from where the object would be located when attached to the handle, into which the thumb may be placed in a third grasping position of the thumb and the first grasping position of the hand when grasping the handle by the member.

2. The handle of claim 1, wherein:

the lower opening is bounded and is in a form of a first closed loop, which includes:

a first front portion that can be placed into contact with the object when attached to the handle;

a first lower portion;

a first rear portion; and a first upper portion which blends into a handle member mid-section; and the upper opening also is bounded and is a form of a second closed loop, which includes:

a second front portion;

a second lower portion, which also blends into the handle member mid-section;

a second rear portion; and a second upper portion.

3. The handle of claim 2, wherein at least one of the following features (A', B', C', D') is provided in the member:

(A') the first front portion is thinner nearer a bottom away from the object when attached to the handle so as to more closely accommodate a slightly upward, underhand grip for less stressful use;

(B') the first lower portion provides or blends into a built-in hammer heel, which is useful for tapping shut a lid for a can of paint as the object;

(C') the first rear portion is thick and stout enough to be grasped;

(D') the second upper portion is extended more upwardly about the rear to provide a wedge sloping down from the second rear portion to the second front portion.

4. The handle of claim 3, wherein at least two of the features from among A', B', C' and D' are provided.

5. The handle of claim 3, wherein at least three of the features from among A', B', C' and D' are provided.

6. The handle of claim 3, wherein all four of the features from among A', B', C' and D' are provided.

7. The handle of claim 1, wherein at least one add-on component receiving opening is provided in the member, which includes at least one of the following (A", B", C"):

(A") a paint can remover receiving opening;

(B") a rear magnet receiving opening; and (C") an upper magnet receiving opening.

8. The handle of claim 1, wherein at least two of the add-on component receiving openings from among A", B" and C" are provided.

9. The handle of claim 7, wherein all three add-on component receiving openings from among A", B" and C" are provided.

10. The handle of claim 1, wherein at least one add-on component is provided in the member, which includes at least one of a paint can remover, a rear magnet, and an upper magnet.

11. The handle of claim 7, wherein at least one add-on component is provided in the member, which includes at least one of a paint can remover, a rear magnet, and an upper magnet, by being received into a corresponding add-on component receiving opening, which includes at least one of A", in which the paint can remover is received; B", in which the rear magnet is received; and C", in which the upper magnet is received.

12. The handle of claim 1, wherein the member has a split configuration.

13. The handle of claim 11, wherein the member has a split configuration.

14. The handle of claim 1, which further comprises a strap attached to the member for embracing and securing the object.

15. The handle of claim 14, wherein the strap includes a band portion having a tension buffer segment, and a band lock.

16. A combination of a handle and an object, wherein the handle comprises:

a member for grasping with a hand, wherein the member has a lower opening for passage or accommodation of fingers and a web or palm of the hand, and an upper opening for passage or accommodation of a thumb of the hand;

wherein the member comprises a thick middle section between the upper opening and the lower opening, a bolt accommodating hole extending through the middle section;

the member further comprises:

a first digit-placement impression comprising a front impression in a front location between the upper opening and a location closer to where the object would be located when attached to the handle, into which the thumb may be placed in a first grasping position of the thumb and a first grasping position of the hand when grasping the handle by the member;

a second digit-placement impression comprising a middle impression in a middle location on the middle section between the lower opening and the upper opening, into which the thumb may be placed in a second grasping position of the thumb and a second grasping position of the hand when grasping the handle by the member; and a third digit-placement impression comprising an upper impression in an upper location above the upper opening but further from where the object would be located when attached to the handle, into which the thumb may be placed in a third grasping position of the thumb and the first grasping position of the hand when grasping the handle by the member.

* * * * *

UNITED STATES PATENT AND TRADEMARK OFFICE

CERTIFICATE OF CORRECTION

PATENT NO. : 9,021,662 B1
APPLICATION NO. : 13/999227
DATED : May 5, 2015
INVENTOR(S) : Michael A. Jones It is certified that error appears in the above-identified patent and that said Letters Patent is hereby corrected as shown below:

In the Specification

In column 1, line 13, after the word, "can," insert a second recitation of the word, --can.--

In column 2, line 31, after the word, "can," insert a second recitation of the word, --can.--

In the Claims

In claim 8, line 1, i.e., column 7, line 21, after the word, "claim," delete "1," and insert --7,-- therefor Signed and Sealed this
Thirtieth Day of June, 2015

Michelle K. Lee

Michelle K. Lee
*Director of the United States Patent and Trademark Office*